US005639171A

United States Patent [19]

Brewster, Jr. et al.

[11] Patent Number: 5,639,171

[45] Date of Patent: Jun. 17, 1997

[54] MEDIA LENGTH SENSING FOR INCREASED THROUGHPUT EFFICIENCY OF ELECTRONIC PRINTERS

[75] Inventors: William H. Brewster, Jr., Fairfield; Wayne D. Moore, Shelton, both of Conn.

[73] Assignee: Pitney Bowes Inc., Stamford, Conn.

[21] Appl. No.: 382,720

[22] Filed: Feb. 2, 1995

[51] Int. Cl.[6] ..... B41J 11/50

[52] U.S. Cl. ..... 400/708; 400/605; 271/258.03

[58] Field of Search ..... 400/708, 605; 271/258.03

[56] References Cited

U.S. PATENT DOCUMENTS

| | | | |
|---|---|---|---|
| 4,727,437 | 2/1988 | Mizoguchi | 400/708 |
| 4,756,636 | 7/1988 | Maruyama et al. | 400/605 |
| 4,915,525 | 4/1990 | Hosoi | 400/605 |
| 4,934,845 | 6/1990 | Kato | 400/708 |
| 5,061,092 | 10/1991 | Takeda et al. | 400/708 |

*Primary Examiner*—Edgar S. Burr
*Assistant Examiner*—Steven S. Kelley
*Attorney, Agent, or Firm*—Robert E. Meyer; Melvin J. Scolnick

[57] ABSTRACT

The invention is a method whereby the throughput of a printer is varied according to the length of the media piece (e.g., cut-sheet or envelope) that is being fed into the printer feed path. The media piece moves into the feed path by use of a set of take-up rollers and is directed toward a sensor; the sensor detects the piece's leading edge and becomes activated. The activated sensor in turn activates additional feed roller sets which move the media piece along the feed path. Additionally, the sensor detects the trailing edge of the media piece and asks the printer if another image is to be printed. If another image is to be printed, then the take-up rollers are activated and begin feeding the next piece of media. If another image is not to be printed, then the sensor is deactivated. The feed rollers move the media piece along the printer's feed path and toward a second sensor which detects the leading edge of the media piece and is activated. Once activated, the sensor activates a set of exit rollers which are used for exiting the media piece from the printer. When the activated sensor detects the trailing edge of the media piece, the sensor is deactivated.

10 Claims, 10 Drawing Sheets

MEDIA LENGTH SENSING FOR INCREASED THROUGHPUT EFFICIENCY OF ELECTRONIC PRINTERS

BACKGROUND OF THE INVENTION

The invention relates to a method for maximizing the throughput of a printer.

Printers, such as the well-known hp LaserJet printers manufactured by the Hewlett-Packard Company of Boise, Id., print upon pieces of various media types (such as cut-sheets or envelopes) that are fed to the print mechanism at a constant fixed rate. Because the print rate, or throughput, is fixed (e.g., at 8 pages per minute), it takes as much time to print on a #7 sized envelope as it does to print on a letter-sized (8.5×11.0 inches) cut sheet, despite the fact that their lengths are not similar. It would be more efficient, in terms of time, to increase throughput based on the length of the media to be printed upon. Thus, if letter-sized cut sheets could be printed at a rate of 8 pages per minute, then #7 envelopes could be printed at a much faster rate.

Increased throughput can be affected by the use of a jam sensor commonly employed in the printer feed path. Through the use of the present jam sensor, which is generally located just after the feed rollers at the beginning of the paper path and just after the media has exited the cassette, the leading edge and the trailing edge of any length media can be determined. The leading edge would trip the sensor, by way of a switch arm, and activate the sensor. The sensor would stay in the same state for the length of the media piece being fed for printing.

By queuing the start of the next media piece by the switching of the sensor back to the original state with the passing of the trailing edge of the previous piece, a constant gap between each successive piece could be maintained. Thus, if media pieces were shorter than the pre-selected threshold level of a given printer, then more pieces of media could be fed within a given time period while additionally permitting the printing of consecutive pieces of varied or equal length.

SUMMARY OF THE INVENTION

According to the invention, the disadvantages of the prior art are overcome by a method for varying the throughput of a printer. The throughput is affected by the length of the media piece (e.g., legal or letter-size cut sheets or envelopes) that is being fed from a media source into the printer feed path.

The chosen media piece is fed from the media source, by use of a set of take-up rollers in the entrance to the printer feed path. Upon entering the feed path, the first piece of media is directed toward a first sensor means for detecting the leading edge of the media piece. The first sensor detects the leading edge of the media piece and is placed in the on position.

The on position first sensor causes the one or more additional feed roller sets of the printer's feed path to be activated and these in turn feed the media piece along the feed path. Additionally, the on position first sensor detects the trailing edge of the media piece and requests of the printer controller whether or not another image is to be printed upon the surface of subsequent media piece. If another image is to be printed, then the on position first sensor, in conjunction with the printer controller, causes the take-up rollers to begin feeding the next piece of media; and, if another image is not to be printed, then the sensor is turned off. The means for printing upon the media surface are contained within the printer and in line with the printer path in such a way as to print within certain designated parameters under the control of the printer controller.

In an alternative embodiment of the invention, that is best employed when media pieces are of equal length, the printer controller calculates the length of the media being fed and then optimizes the activation of the take-up rollers for the feeding of subsequent media pieces.

The one or more sets of feed rollers move the media piece along the printer's feed path and toward a second sensor. The second sensor detects the leading edge of the media piece and is placed in the on position. Once in the on position, the on position second sensor in turn causes a set of exit rollers which are used for exiting the media piece from the feed path through an exit of the printer to be activated. When the on position second sensor detects the trailing edge of the media piece, the sensor is turned off.

A preferred embodiment of the present invention, can utilize as a platform a PC-based mailing or addressing system. These systems generally include among their elements: a microprocessor with associated buffer and hard drive memory; a monitor; a printer; and, other peripheral devices as required.

DETAILED DESCRIPTION OF THE PREFERRED EMBODIMENTS

Figure 1:
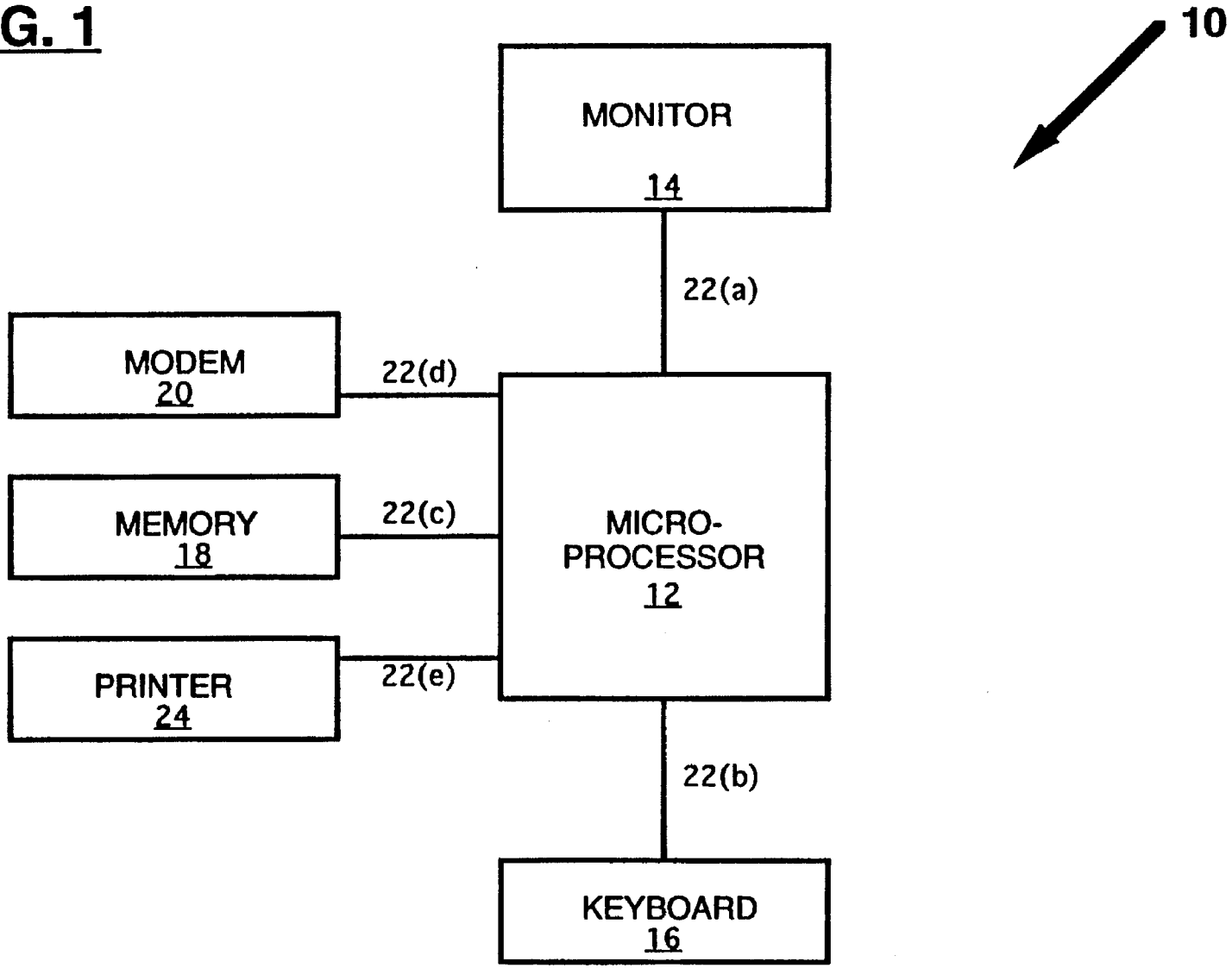
FIG. 1 is a block diagram of an addressing system which may incorporate the present invention.

Turning to FIG. 1, addressing system 10 includes: microprocessor 12 connected to monitor 14 by serial interface cable 22*a;* keyboard 16 connected to microprocessor 12 by serial interface cable 22*b;* memory 18 connected to microprocessor 12 by serial interface cable 22*c;* printer 24 connected to microprocessor 12 by serial interface cable 22*e;* and, modem 20 connected to microprocessor 12 by serial interface cable 22*d.*

Figure 2:
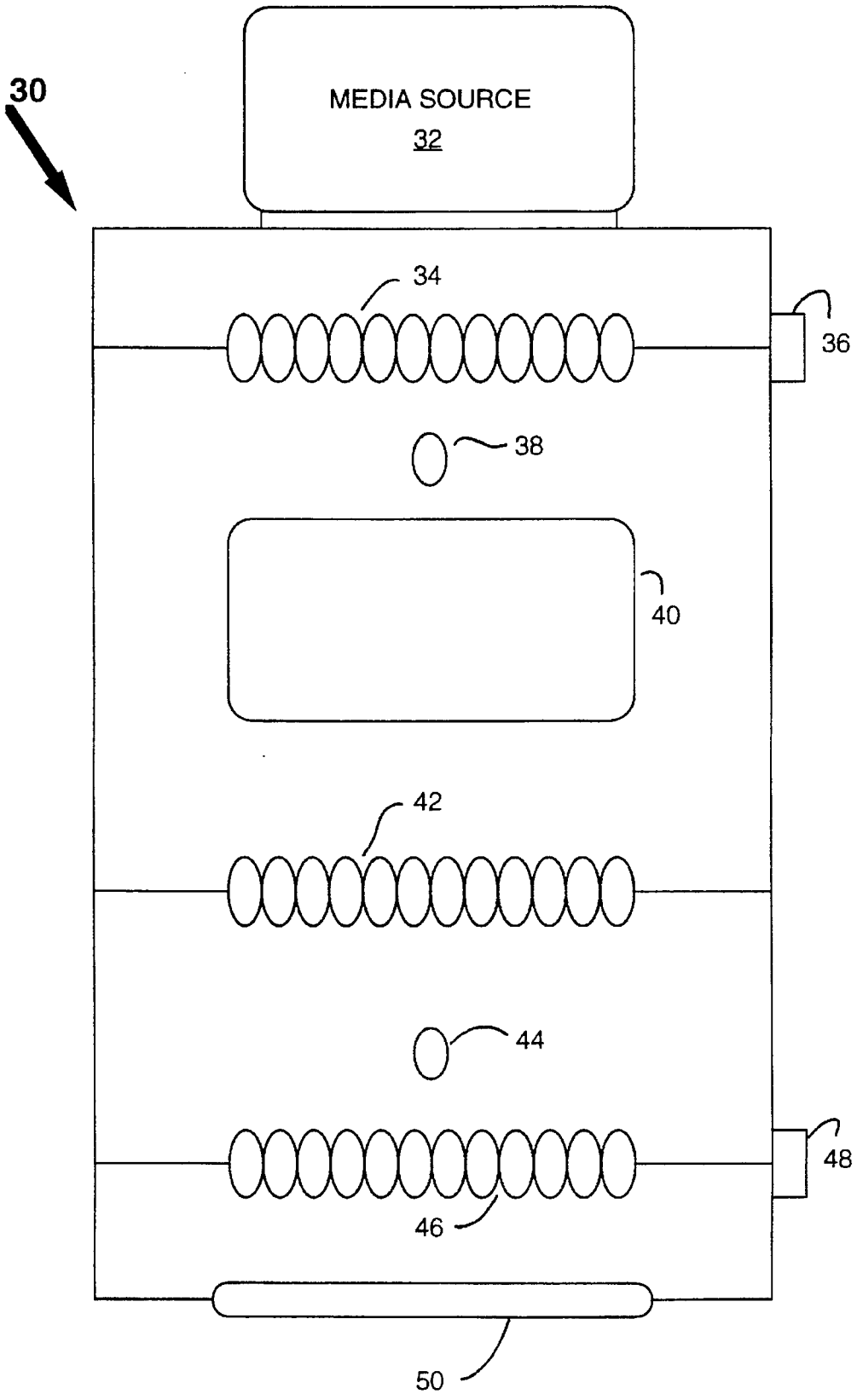
FIG. 2 is a block diagram of the feed path of the printer within the system of FIG. 1.

Turning to FIG. 2, feed path 30 of printer 24 begins at media source 32. Media source 32 is a containment apparatus such as a cassette or a bin feeder that is used to introduce the pieces of a chosen media to feed path 30 of printer 24. Chosen media can take a number of different forms and sizes such as standard letter or legal size cut sheets, or envelopes of varied size. The media pieces can be of mixed length or each piece could be of equal length.

In general, the workings of a printer feeder as depicted in FIG. 2, in controlling the movement of a media sheet, are known. The media pieces are taken-up from media source 32 by feed rollers 34. Feed rollers 34 can be connected to additional feed rollers 42 and 46 by feed clutch 36 or can simply be driven by a separate feed roller motor. The leading edge of the media piece comes into contact with sensor 38 which can initiate several actions which are discussed hereinbelow. As the media piece passes the sensor, sensor 38 will also sense the trailing edge of the media piece and return to its off state. As the media piece passes under sensor 38, the printer controller begins timing the passage of the media piece, comparing the timing of the media piece passage to a pre-determined time. The printer controller continues timing of the passage until the trailing edge of the media piece causes the sensor to be turned off. If the timing of the media piece passage is less than the pre-determined time, then feed roller sets 34, 42, and 46 will continue to feed the media piece until that piece exits printer 24. If the timing of the media piece passage is longer in duration than the pre-determined time, then roller sets 34, 42, and 46 are deactivated and printer 24 indicates to system 10 that a jam has occurred in feed path 30.

As the media piece is fed through feed path 30 by feed roller sets 34 and 42, it is positioned within print area 40 where the printing mechanism, under direction of the printer controller, will print an image upon the media piece. The media piece continues to be fed through feed path 30 and is taken up by feed rollers 42. Feed rollers 42 direct the media piece to sensor 44 which can be used as a jam sensor in the same manner as sensor 38 was used. As the leading edge of the mail piece passes sensor 44, feed roller clutch 48 is activated in order to engage exit rollers 46 with feed rollers 42. Alternatively, sensor 44 could cause a separate exit feed roller motor to be engaged in order to feed the media piece from the feed path and out through feed path exit 50.

Figure 3:
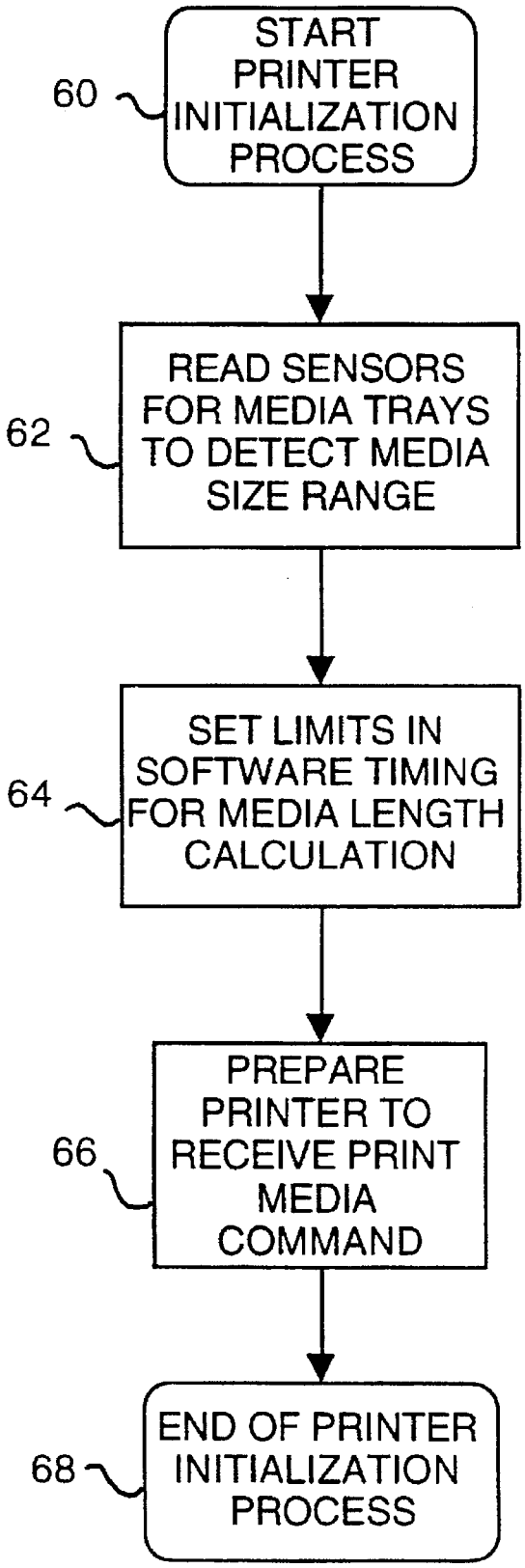
FIG. 3 is a flow chart of the printer initialization process to be employed while utilizing the system of FIG. 1.

Turning to FIG. 3, addressing system 10 utilizing printer 24 starts the printer initialization process at step 60. Initialization of printers is generally dependent upon the printer being employed within the system and is a process which readies the printer for acceptance of data and then checks to see if the printer feed path is clear prior to feeding the chosen media.

Printer 24 at step 62 will read media source 32 sensors to detect the size range of the media. The sensors are normally located within the the area of printer 24 that mates with media source 32. At step 34, the software controlling printer 24 sets limits for the timing of the media length calculation and then prepares printer 24 to receive the print media command at step 36. The media length calculation is used to calculate media piece size for feeding efficiency as well as for the printing limitations in regard to the print surface available for printing an image. When printer 24 is prepared to receive the print media command, then the end of the printer initialization process, step 38, has been achieved.

Figure 3A:
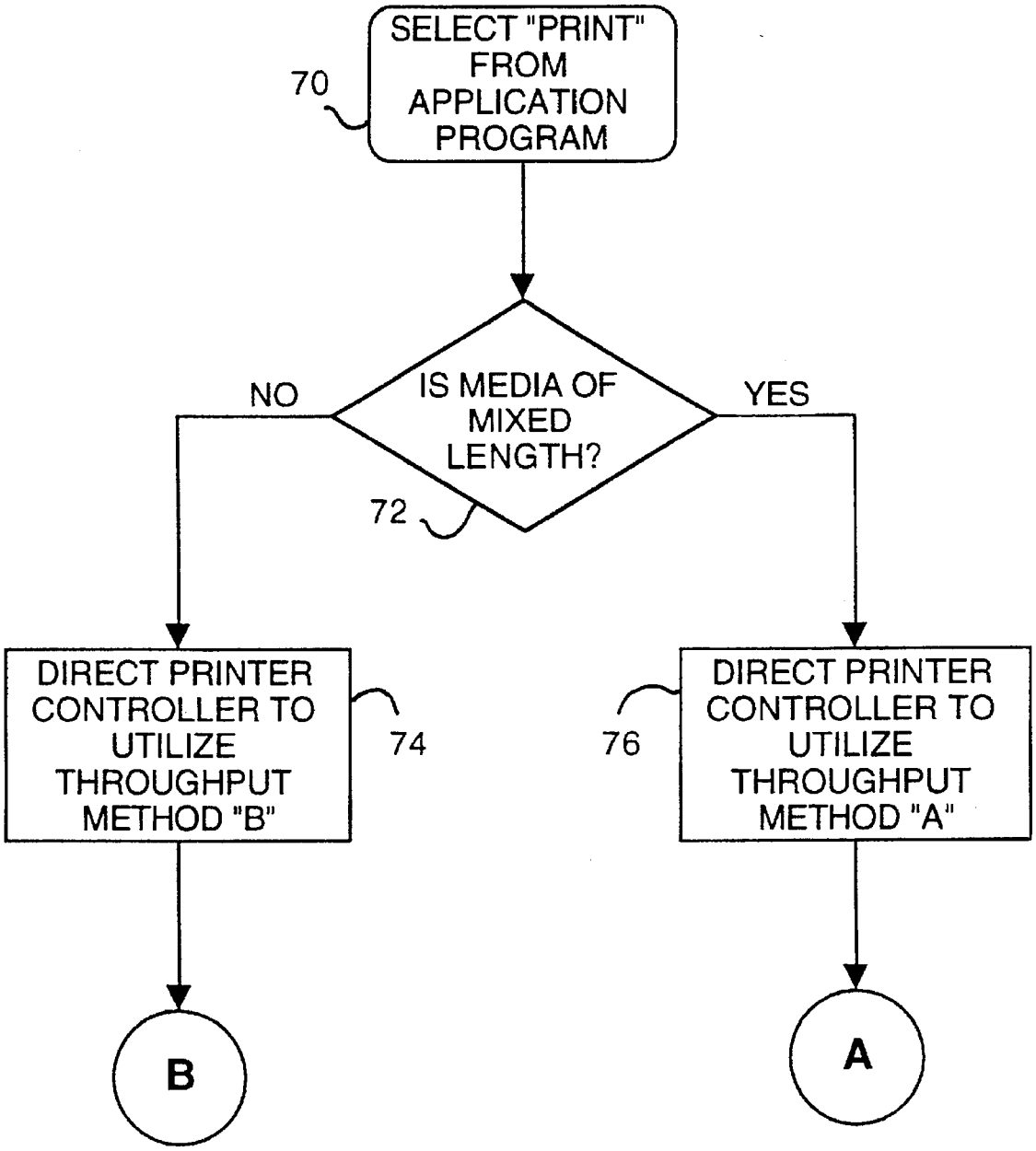
FIG. 3A is a flow chart of the selection process for determining throughput method.

The increased efficiency of printer 24 throughput is accomplished by selecting the throughput method best suited for the chosen media contained in media source 32. Turning to FIG. 3A, the selection of the throughput method is disclosed.

Figure 6:
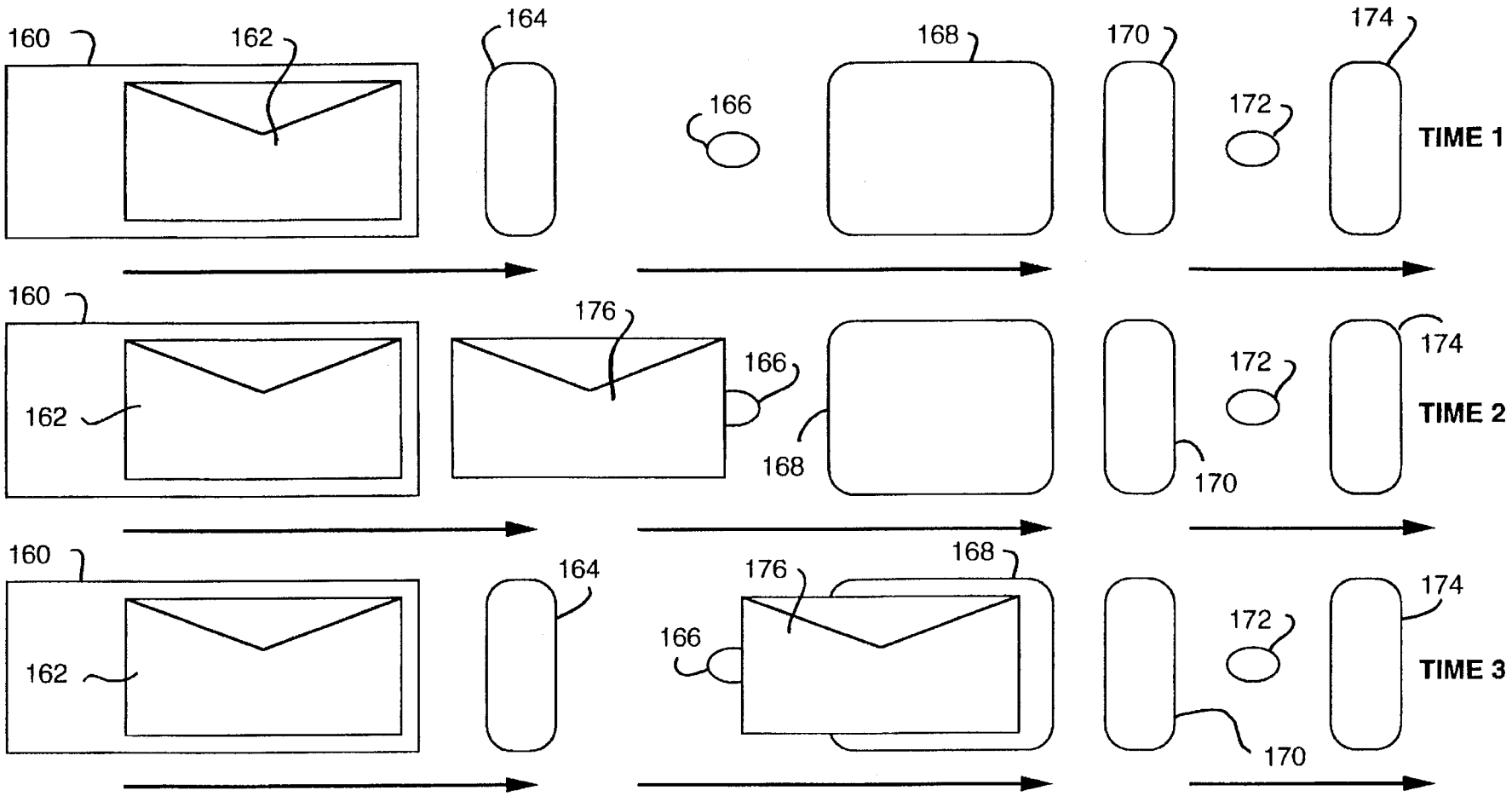
FIG. 6 is flow diagram for the passage of the media piece through the printer feed path when utilizing mixed length media.

When "PRINT" has been selected from within the application program at step 70, a number of parameters can be set, such as: the number of images to be printed; print limitations if any; and media size. Throughput can be made more efficient by minimizing the gap that occurs between successive pieces of media that are being fed through feed path 30. This is illustrated in FIG. 6 and in FIG. 7. Therefore, it is important to select the most efficient throughput method available for a given media type. At step 72, system 10 inquires as to the length of the media that is contained in media source 32. If the media is of mixed length, then the printer controller is directed to utilize throughput method "A". If the media pieces are of equal length, then the printer controller is directed to utilize throughput method "B".

If limitations of the application program would keep the printer controller from making a choice between throughput methods "A" or "B", then the controller of printer 24 will default to the throughput method best suited to the capabilities of media source 32.

Figure 4:
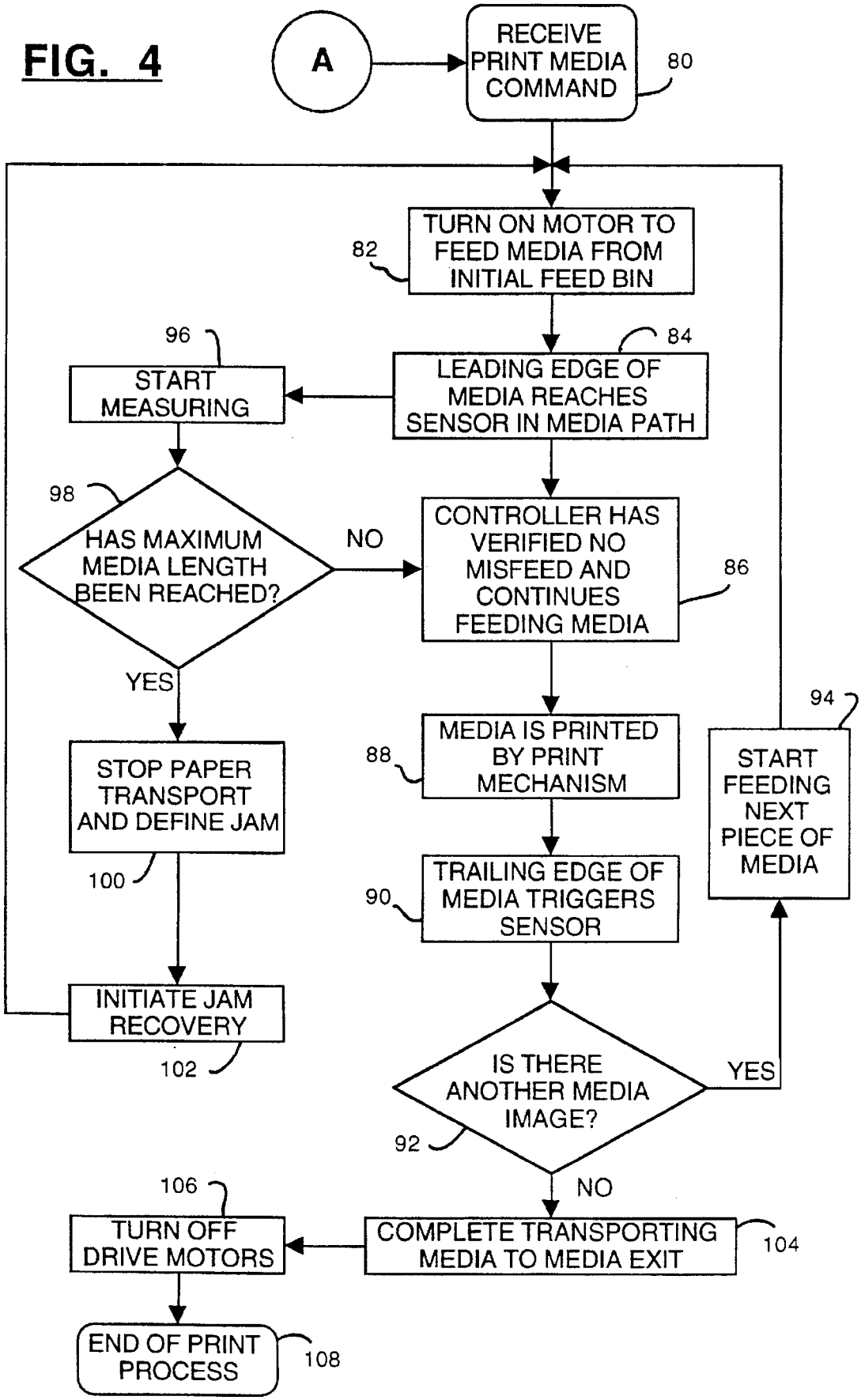
FIG. 4 is a flow chart of the media length sensing method employed after initialization of the printer in FIG. 2.

Turning to FIG. 4, throughput method "A" is disclosed in which addressing system 10 delivers the print media command to printer 24 at step 80. The controller of printer 24 turns on the motor at step 82 that controls take-up rollers 34 at the feed path entrance; take-up rollers 34 can be driven by a separate take-up roller motor or can be engaged by clutch 36 to feed rollers 42. Take-up rollers 34 will take-up the first media piece from media source 32 and feed the first media piece into feed path 30 of printer 24.

As is known to those skilled in the art, printers generally utilize one or more sets of rollers to feed a media piece from a cassette, into and through the feed area, and then onto and through the printer feed path exit. A single motor, under direction of the printer controller, can be used to drive the feed rollers. A clutch assembly can be used in conjunction with the feed rollers that take-up the media from the cassette and introduce the media to the printer feed path; the rollers doing the take-up of the media can be referred to as take-up rollers and are selectively engaged or disengaged from the other feed rollers as determined by the printer controller. It is also possible to utilize a separate motor for the take-up rollers and thereby negate the need for a clutch assembly. The take-up rollers motor would be under the control of the printer controller.

Additionally, a clutch assembly can be used in conjunction with the feed rollers that exit the media from the printer feed path; the rollers that exit the media can be referred to as exit rollers and are selectively engaged or disengaged from the other feed rollers as determined by the printer controller. It is also possible to utilize a separate motor for the exit rollers and thereby negate the need for a clutch assembly. The exit rollers motor would be under the control of the printer controller.

At step 64, the leading edge of the media piece reaches sensor 38 located in feed path 30. Sensor 38 is a photo electric type that employs a switch arm that is pushed into a blocking position by the passage of the media piece; this is common to the art. Sensor 38 will become activated which causes printer 24 to begin measuring the length of the media piece at step 96. If at step 98 it is determined that the maximum media length has been exceeded, then printer 24 will stop feed rollers 34, 42, and 46 and indicate at step 100, to the system 10 for display on monitor 14, that a printer jam has occurred. Printer 24 initiates jam recovery in conjunction with the system operator at step 102 and then returns to step 82 to activate feed rollers 34.

Measurement of the media piece by sensor 38 in conjunction with the controller of printer 24 could also be accomplished by embedding an algorithm routine in the printer control software to calculate the length of the media through the timing between the sensor trip from the lead edge until the return to the original state by the passing of the trailing edge. Once the media length is calculated, the timing of the feeding of the next media piece at step 82 could be optimized for any media length. This media length information, once calculated could then be used for other purposes such as print positioning and more accurate jam sensing. Jam sensing is usually done by way of time outs between jam sensors at various stages in the paper path. Very often this method is less accurate for wide variations in media length. Using the exact media length information, jam sensing time outs could be tailored for each type or length of piece being fed.

If the maximum media length is not exceeded at step 98, then the printer 24 controller at step 86 verifies that there has not been a misfeed of the media piece and the media piece is then fed into position by take-up rollers 34 to be printed upon by the print mechanism at step 88. As take-up rollers 34 and feed rollers 42 move the media piece along feed path 30, the trailing edge of the media piece trips sensor 38 at step 90 which causes the printer controller to query at step 92 as to whether or not another media image needs to be printed. If the response at step 92 is "Yes," then printer 24 will start feeding the next piece of media from media source 32 at step 94 by returning to step 82 while continuing to transport the first media piece to feed path exit 50 of printer 24. If the answer at step 92 is "No," then feed rollers 42 and 46 will continue to feed the media piece to feed path exit 50 at step 104.

When the trailing edge of the last media piece has been recorded by exit sensor 44, the controller for printer 24 turns off the drive motors at step 106 which ends the print process at step 108.

Figure 5:
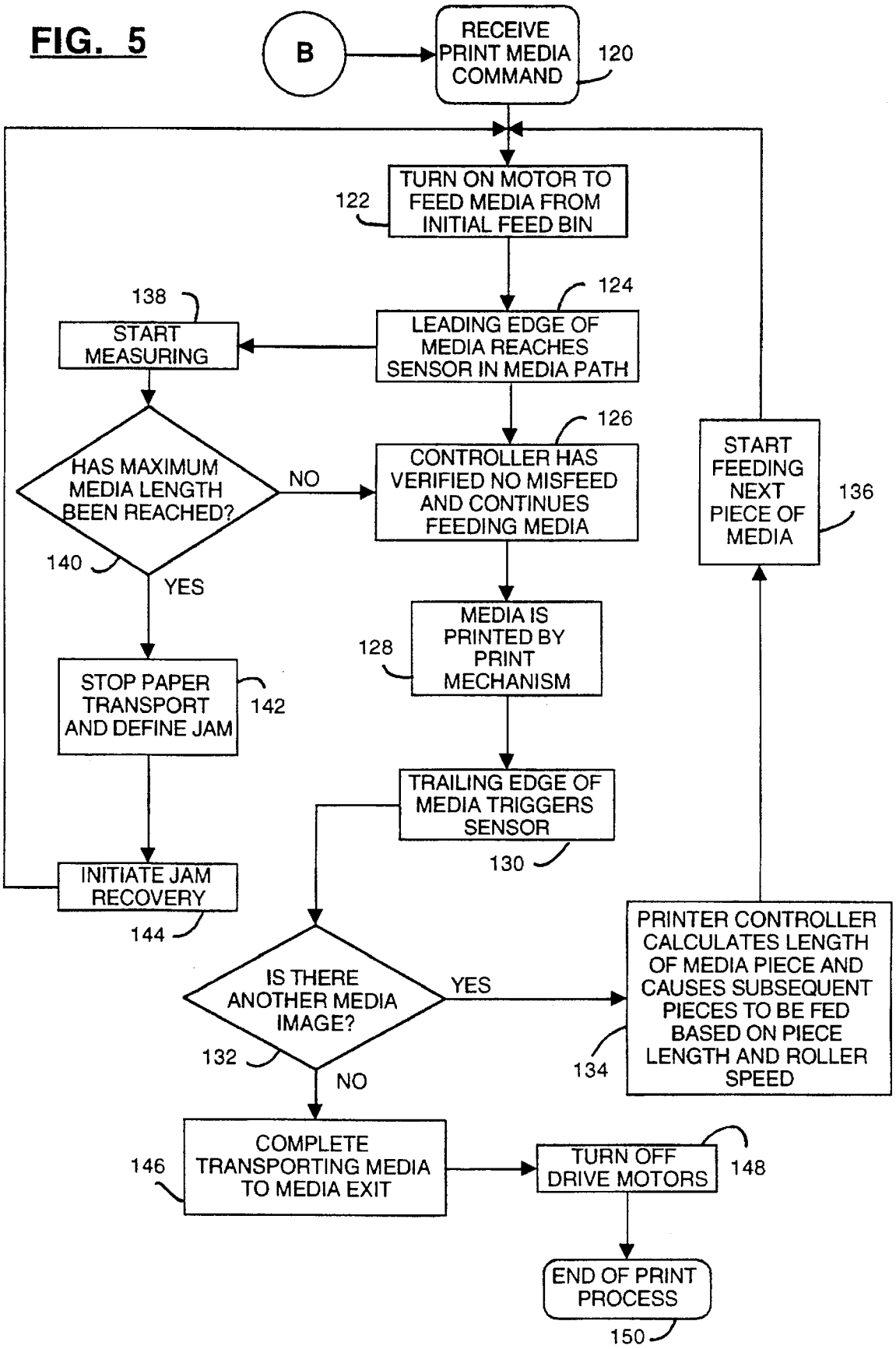
FIG. 5 is a flow chart of an alternative embodiment of the method employed in FIG. 3.

Turning to FIG. 5, an alternative embodiment of the inventive method is illustrated as throughput method "B" wherein feeding of subsequent media pieces is based upon the exact length of the media pieces. This embodiment presents the distinct advantage of being able to time the take-up of pieces from media source 32 by take-up rollers 34 in accordance with the actual length of the media pieces; this reduces the gap necessary between pieces as they are fed into feed path 30. This produces the greatest possible throughput. This embodiment, however, limits each print run to a particular media size.

In this embodiment, the addressing system 10 delivers the print media command to printer 24 at step 120. The controller of printer 24 turns on the motor at step 122 that controls take-up rollers 34 of the feed path entrance which will in turn take-up the first media piece from media source 32 and feed the first media piece into feed path 30.

At step 124, the leading edge of the media piece reaches sensor 38 located in feed path 30. Sensor 38 is a photo electric type that employs a switch arm that is pushed into a blocking position by the passage of the media piece; this is common to the art. Sensor 38 will become activated which causes printer 24 to begin measuring the length of the media piece at step 138. If at step 140 it is determined that the maximum media length has been exceeded, then printer 24 will stop feed rollers 34, 42, and 46 and indicate at step 142, to system 10 for display on monitor 14, that a printer 24 jam has occurred. Printer 24 initiates jam recovery in conjunction with the system operator at step 144 and then returns to step 122 to activate feed rollers 34.

Measurement of the media piece by sensor 38 in conjunction with the printer 24 controller could also be accomplished by embedding an algorithm routine in the printer 24 control software to calculate the length of the media through the timing between the sensor trip from the lead edge until the return to the original state by the passing of the trailing edge. Once the media length is calculated, the timing of the piece feeding at step 122 could be optimized for any media length.

If the maximum media length is not exceeded at step 140, then the printer 24 controller at step 126 verifies that there has not been a misfeed of the media piece and the media piece is then fed into position 40 by take-up rollers 34 and feed rollers 42 to be printed upon by the print mechanism at step 128. As the take-up rollers 34 and feed rollers 42 move the media piece along feed path 30, the trailing edge of the media piece trips sensor 38 at step 130 which causes the printer controller to query at step 132 as to whether or not another media image needs to be printed. If the response at step 132 is "Yes," then the controller for printer 24 will calculate the length of the media being fed and cause take-up rollers 34 to be activated for feeding subsequent media pieces as based upon the media length; this reduces the gap required between pieces. In the prior art, media pieces were fed at a constant rate and the gap between pieces varied with piece length. By measuring sheet length in accordance with the present invention, a constant gap can be maintained between pieces and the feed rate, or throughput rate, correspondingly increased for shorter pieces.

The controller for printer 24 will cause take-up rollers 34 to begin feeding the next piece of media at step 136 by returning to step 122 while exit rollers 46 transport the first media piece to feed path exit 50. If the answer at step 132 is "No," then feed rollers 42 and exit rollers 46 will continue to feed the media piece to the feed path exit at step 146.

When the trailing edge of the last media piece has been recorded by exit sensor 44, the controller for printer 24 turns off the drive motors at step 148 which ends the print process at step 150.

Turning to FIG. 6, a conceptual flow of throughput method "A" is disclosed. The timing of the media piece flow can be observed over three points in time.

At time point 1, a stack of media pieces 162, contained within media source 160, is in position to be taken-up into the feed path by take-up rollers 164. The remainder of the feed path is clear and sensors 166 and 172, feed roller sets 164, 170, and 174 and print positioning area 168 are illustrated.

At time point 2, first media piece 176 of stack 162 has been taken-up by take-up rollers 164. First media piece 176 has been fed forward until it activates sensor 166.

At time point 3, first media piece 176 has been fed forward to print positioning area 168 to be printed upon by the print mechanism. As the trailing edge of first media piece 176 passes over sensor 166, the printer controller directs a second piece of media from stack 162 to be taken-up by take-up rollers 164. Within throughput method "A", time point 3 represents the widest possible gap between successive media pieces.

Figure 6A:
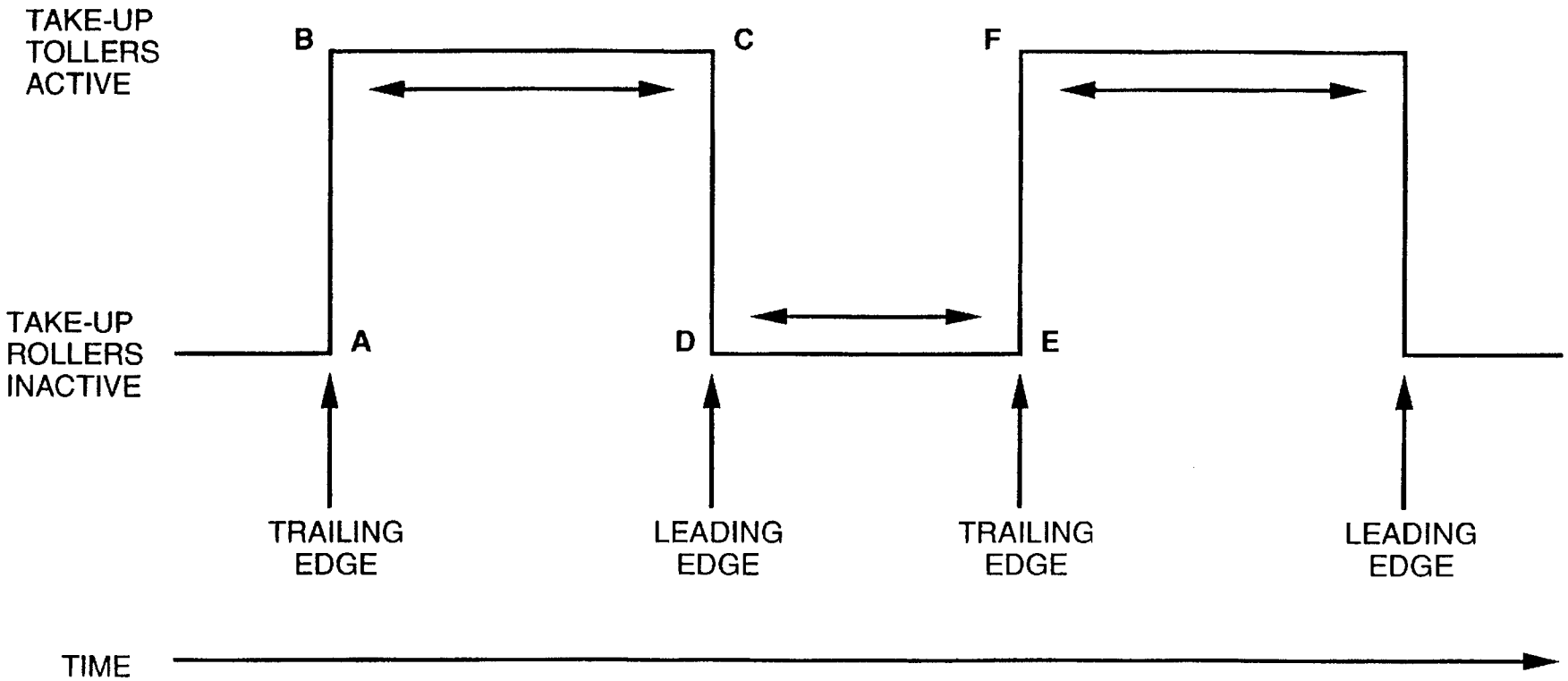
FIG. 6A is a timing diagram for the flow of FIG. 6.

FIG. 6A is a time chart of the flow of FIG. 6 in which the activity of the take-up rollers 164 is demonstrated as a function of time. As the trailing edge of the media piece passes sensor 166 at point A, take-up rollers 164 become active at point B. Take-up rollers 164 remain active until the leading edge of the media piece passes over feed rollers 164 and trips sensor 166 at point C and feed rollers 164 become inactive at point D. At point D, the leading edge of the media piece passes over sensor 166 and rollers 164 remain inactive until the trailing edge of the media piece passes over sensor 166 at point E. At point E, the take-up rollers 164 become active and at point F, the take-up rollers begin feeding a next media piece. The cycle continues until all print images have been printed.

Figure 7:
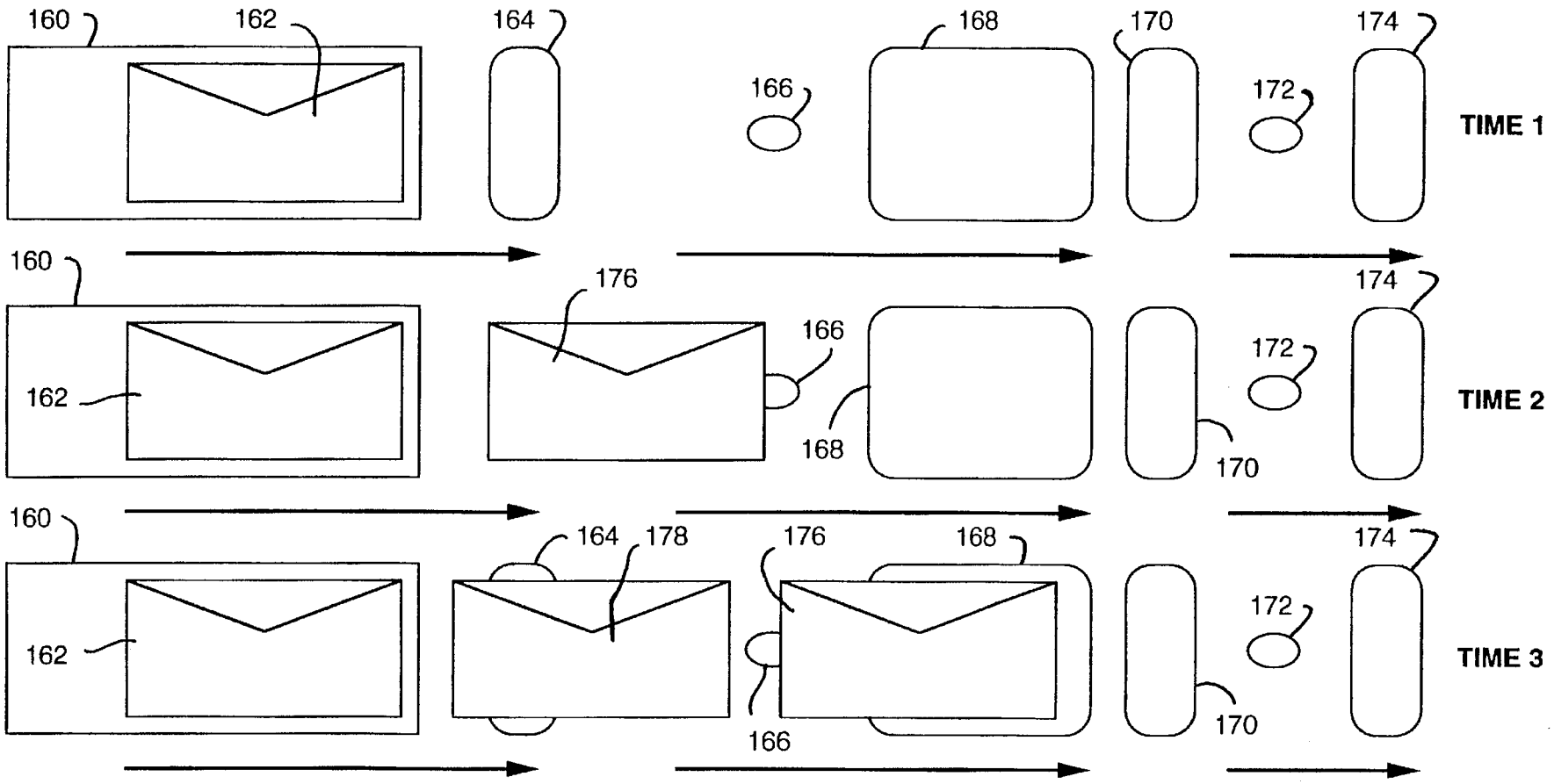
FIG. 7 is flow diagram for the passage of the media piece through the printer feed path when utilizing common length media.

Turning to FIG. 7, a conceptual flow of throughput method "B" is disclosed. The timing of the media piece flow can be observed over three points in time.

At time point 1, a stack of media pieces 162, contained within media source 160, is in position to be taken-up into the feed path by take-up rollers 164. The remainder of the feed path is clear and sensors 166 and 172, feed roller sets 164, 170, and 174 and print positioning area 168 are illustrated.

At time point 2, first media piece 176 of stack 162 has been taken-up by take-up rollers 164. First media piece 176 has been fed forward until it activates sensor 166 which causes the printer controller to begin measuring the length of first media piece 176 and to start the take-up rollers for feeding of a next media piece as based upon the roller speed and the maximum possible length of a next media piece.

At time point 3, first media piece 176 has been fed forward to print positioning area 168 to be printed upon by the print mechanism. As the trailing edge of first media piece 176 passes over sensor 166, the printer controller has finished measuring the length of the first media piece and will use that length to calculate subsequent starts of take-up rollers 164. Second media piece 178 has been taken-up from stack 162 by take-up rollers 164. Within throughput method "B", the gap between successive media pieces will be optimized based on the length of the media pieces. The gap between the first and second media pieces will be the least optimized because take-up of the second media piece was not based on the length of the first media piece.

Figure 7A:
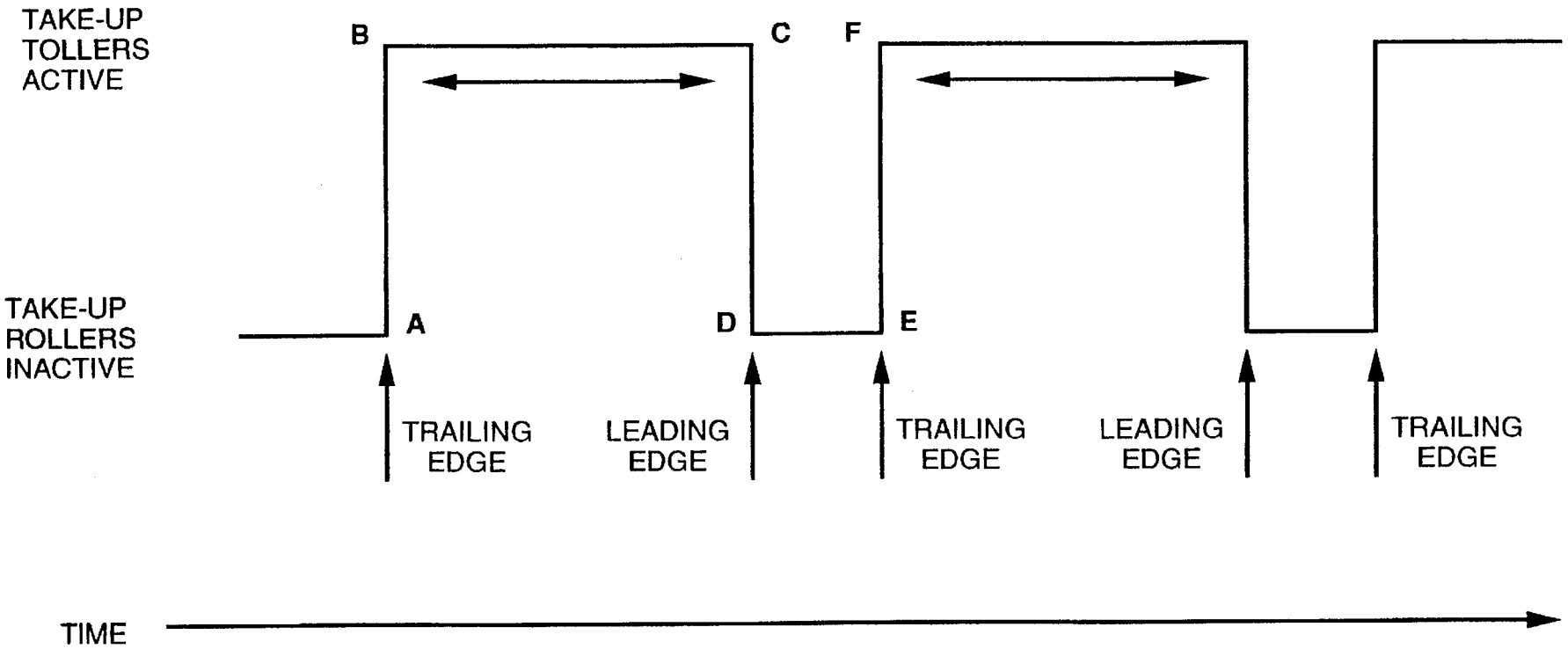
FIG. 7A is a timing diagram for the flow of FIG. 7.

FIG. 7A is a time chart of the flow of FIG. 7 in which the activity of the take-up rollers 164 is demonstrated as a function of time. Take-up rollers 164 become active at point B base not on the movement of the prior media piece but on its length. Take-up rollers 164 remain active until the media piece passes over the feed rollers and the calculated gap has been determined by the printer controller at point C and feed rollers 164 become inactive at point D. Thus, it can be seen that the gap represented by segment DE, which is the inactive time of take-up rollers 164, is minimized as compared to the same gap in FIG. 6A. The cycle continues until all print images have been printed.

As can be appreciated by those skilled in the art, a number of variations of the subject invention are possible. These variations include, but are not limited to: the range of printer types that can utilize the inventive method; the size and complexities of the printer feed path as well as the distance between rollers and sensors within the feed path; the number of motors utilized to drive the feed rollers, inclusive or exclusive of the take-up and/or exit rollers; the ability to accept media of varied size into the feed path; the nature of the print mechanism; and, the general configuration of the host computer and its array of peripherals.

Additionally, the ability to choose among throughput methods can be effected by the application program utilized or by the physical limitations of the printer. It Would also be possible to employ a switch located on or within the printer housing, that will manually select the throughput method best suited to the chosen media.

What is claimed is:

1. A method for optimizing the throughput of a printer, comprising the steps of:

(a) providing a plurality of pieces of media for input to said printer, and determining whether or not said plurality of media pieces are of mixed length or are of equal length;

(b) inputting a first media piece to said printer at a pre-determined rate and activating a jam length sensor, wherein said sensor has a pre-determined default setting;

(c) sensing a leading and a trailing edge of said first media piece as said first media piece passes a position sensor;

(d) responding to said sensor's output to determine a length of said first media piece;

(e) replacing said pre-determined default setting of said jam length sensor with a value corresponding to said determined length if said value is less than said pre-determined default setting and if said plurality of media pieces are of equal length:

(f) determining a time interval as a function of said length, said pre-determined rate, said value, and a pre-determined gap, said time interval being chosen to maintain said pre-determined gap between each of said plurality of media pieces;

(g) responding to said position sensor's output to wait said time interval and then inputting a next media piece, whereby an optimal gap is created when said pre-determined gap is maintained between successive media pieces; and (h) wherein said optimal gap is calculated to minimize a gap between a trailing edge of a media piece being fed through said printer and a leading edge of said successive media pieces.

2. The method of claim 1 wherein:

(a) said sensor detects said leading edge of said media piece and is placed in an on position;

(b) said on position sensor detects said trailing edge of said media piece and causes said printer controller to determine whether or not another image is to be printed:

(i) if another image is to be printed, then said printer controller directs a first set of feed rollers to start feeding said second and third media pieces and said successive media pieces and said on position sensor is turned off; and (ii) if another image is not to be printed, then said on position sensor is turned off.

3. The method of claim 1 wherein said printer controller detects whether or not said media piece has jammed within said printer by use of a second sensor placed in said printer's feed path in a location after said print mechanism print area and prior to said printer's feed path exit.

4. The method of claim 3 wherein:

(a) said second sensor detects said leading edge of said media piece and is placed in an on position;

(b) said on position second sensor causes said printer controller to direct a set of exit rollers of said printer to be activated;

(c) said activated exit rollers feed said media piece to said printer's feed path exit; and (d) said on position second sensor detects said trailing edge of said media piece and is turned off.

5. The method of claim 1, wherein a calculation is made by said printer controller, based upon a relative position of said leading edge of said media piece, of when a means for printing an image upon said media piece is to be activated by said printer controller.

6. The method of claim 2, wherein said activation of said first set of feed rollers is accomplished when said printer controller directs a feed roller clutch to engage and thereby connecting said first set of feed rollers with an at least one additional feed roller set.

7. The method of claim 2, wherein said activation of said first set of feed rollers is accomplished when said printer controller directs a feed roller motor to engage and thereby activating said first set of feed rollers.

8. The method of claim 3 comprising the steps of:

(a) placing said second sensor in an on position which causes said printer controller to begin timing the passage of said media piece across said second sensor;

(b) comparing said timing of said media piece passage to a pre-determined time by said printer controller;

(c) continuing said timing of said media piece passage until said trailing edge of said media piece causes said second sensor to be turned off; and (i) if said timing of said media piece passage is less than said pre-determined time, then said at least one additional feed roller sets will continue to feed said media piece until said media piece exits said printer; and (ii) if said timing of said media piece passage is more than said pre-determined time, then said at least one additional feed roller sets are deactivated and said printer indicates that a jam has occurred in said printer.

9. A method of optimizing the throughput of a printer comprising the steps of:

(a) selecting, in an application program, whether or not a plurality of media pieces contained in a containment apparatus are of equal length or are of varied length;

(b) directing said printer's controller to select a method of feeding successive pieces of said plurality of media pieces based upon said selection of whether or not said plurality of media pieces are of equal length or are of varied length;

(i) if said plurality of media pieces are of equal length, then said selected method will be based upon said printer controller calculating an optimal time for take-up of a next piece of said plurality of media pieces from said containment apparatus; said optimal time based upon the length of said media piece relative to time and motor speed of said printer's feed roller set;

(ii) if said plurality of media pieces are not of equal length, then said selected method will be based upon said controller directing a first set of feed rollers to take-up a next piece of said plurality of media pieces from said containment apparatus when a sensor placed in said printer's feed path detects a trailing edge of an immediately previous media piece.

10. The method of claim 9 wherein said apparatus for containing a plurality of media pieces is a cassette or a bin feeder.

* * * * *